US009598807B2

(12) United States Patent
Brown

(10) Patent No.: US 9,598,807 B2
(45) Date of Patent: Mar. 21, 2017

(54) LID LOCK FOR HOUSEHOLD APPLIANCE

(75) Inventor: Adam R. Brown, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1065 days.

(21) Appl. No.: 13/571,447

(22) Filed: Aug. 10, 2012

(65) Prior Publication Data

US 2014/0042881 A1 Feb. 13, 2014

(51) Int. Cl.

| | |
|---|---|
| ***D06F 23/04*** | (2006.01) |
| ***D06F 37/42*** | (2006.01) |
| ***D06F 39/14*** | (2006.01) |

(52) U.S. Cl.

CPC ..... *D06F 23/04* (2013.01); *D06F 37/42* (2013.01); *D06F 39/14* (2013.01)

(58) Field of Classification Search

CPC ..... D06F 37/28; D06F 39/14; A47L 15/4257; A47L 15/4259; A47L 15/4261; A47L 15/4263; B65B 7/2842; B65D 51/14

See application file for complete search history.

(56) References Cited

U.S. PATENT DOCUMENTS

| | | | | |
|---|---|---|---|---|
| 2,005,792 | A * | 6/1935 | Leins | 126/39 R |
| 4,365,830 | A | 12/1982 | Paulson | |
| 4,753,367 | A * | 6/1988 | Miller et al. | 220/495.11 |
| 7,251,961 | B2 | 8/2007 | Hapke et al. | |
| 7,775,070 | B2 | 8/2010 | Lim et al. | |
| 2012/0175894 | A1 | 7/2012 | Hapke et al. | |

FOREIGN PATENT DOCUMENTS

| | | | |
|---|---|---|---|
| WO | 2011109235 | A1 | 9/2011 |
| WO | WO 2011109235 | A1 * | 9/2011 |

* cited by examiner

*Primary Examiner* — Karla Moore
*Assistant Examiner* — Tinsae Ayalew

(57) ABSTRACT

A household appliance for treating at least one item according to at least one cycle of operation, includes a treating chamber with an access opening, a cover, and lock mechanism to secure the cover closed over the access opening. The lock mechanism is configured to allow the cover to be forced open without breaking the lock mechanism.

10 Claims, 8 Drawing Sheets

LID LOCK FOR HOUSEHOLD APPLIANCE

BACKGROUND

Household appliances, such as clothes washers and dryers, may include a treating chamber in which items are placed for treating and a cover, such as a lid or door, for closing an access opening to the treating chamber. The cover can be locked in the closed position during a portion of a cycle of operation, such as during the spin phase when wash liquid is removed from laundry by spinning the treating chamber at a high speed, and is typically configured to automatically unlock after completion of the spin phase. If a user forcibly opens the cover during the spin phase, the lock may be broken.

BRIEF DESCRIPTION OF THE INVENTION

According to an embodiment of the invention, a laundry treating appliance for treating a laundry load according to at least one cycle of operation comprises a housing having an access opening, a treating chamber provided in the housing for receiving the laundry load via the access opening for treatment according to the at least one cycle of operation, a cover moveably mounted to the housing to selectively close the access opening, and a lock mechanism to secure the cover closed over the access opening. The lock mechanism comprises a bezel provided on the housing and defining a bezel opening, a strike provided on the cover and selectively received by the bezel opening, and a strike trap provided on the housing to selectively retain the strike within the bezel opening, wherein the bezel is movable relative to the housing in a manner to enable the strike to be freed from the strike trap against a predetermined force acting on the cover.

DESCRIPTION OF EMBODIMENTS OF THE INVENTION

Figure 1:
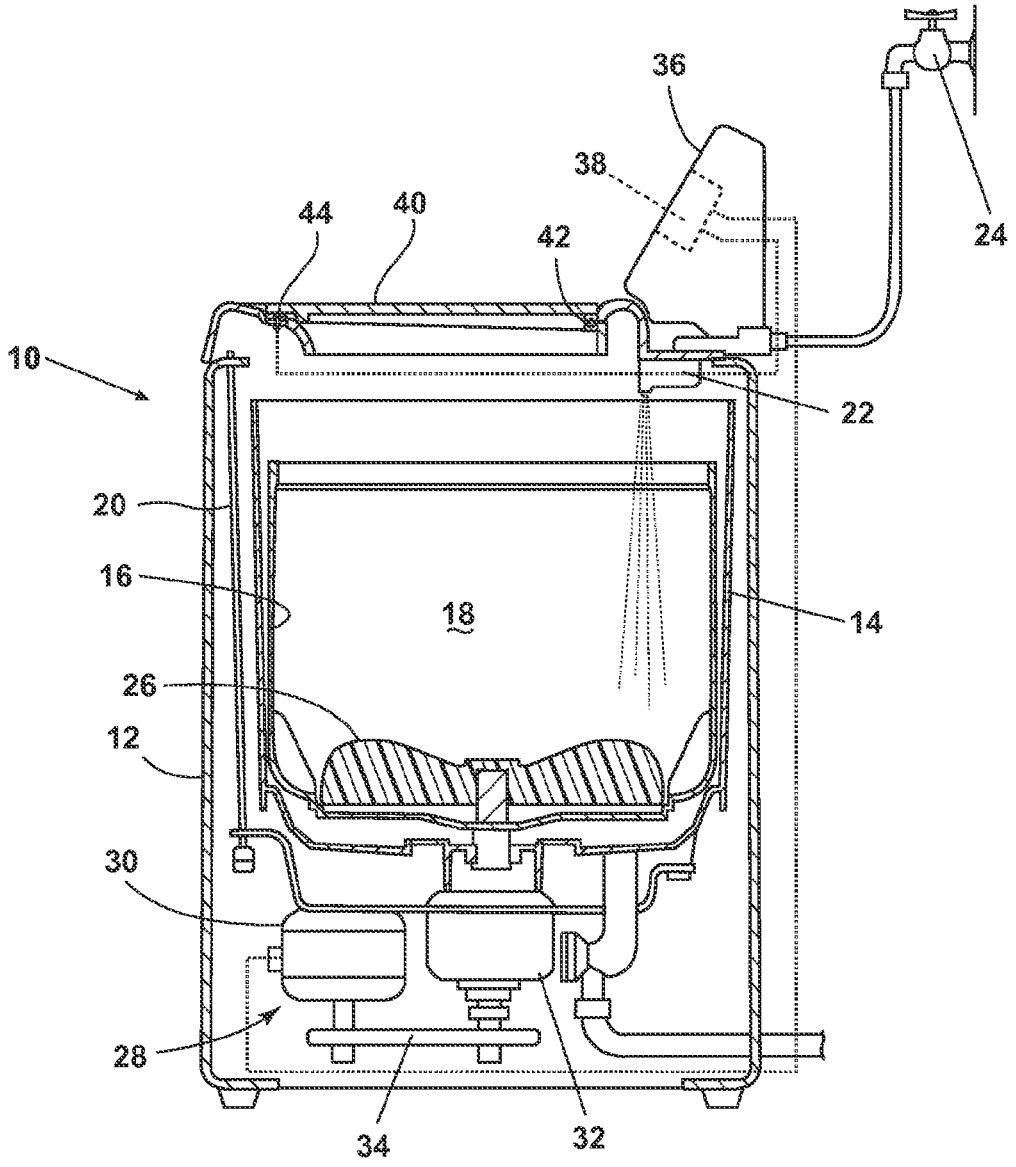
FIG. 1 is a schematic view of a laundry treating appliance in the form of a clothes washer having a cover and a lock mechanism for the cover.

FIG. 1 is a schematic view of a laundry treating appliance. The laundry treating appliance may be any appliance which includes a treating chamber for receiving at least one item for treatment and performs a cycle of operation to clean or otherwise treat items placed therein, non-limiting examples of which include a horizontal or vertical axis clothes washer; a horizontal or vertical axis clothes dryer; a combination washing machine and dryer; a tumbling or stationary refreshing/revitalizing machine; an extractor; a non-aqueous washing apparatus; and a revitalizing machine.

The laundry treating appliance of FIG. 1 is illustrated as a vertical-axis or top-load clothes washer 10 which may include a structural support system comprising a cabinet 12 which defines a housing within which a laundry holding system resides. The cabinet 12 may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

The laundry holding system comprises a tub 14 supported within the cabinet 12 and a drum 16 provided within the tub 14, the drum 16 defining at least a portion of a laundry treating chamber 18. The drum 16 may include a plurality of perforations such that liquid may flow between the tub 14 and the drum 16 through the perforations. The clothes washer 10 may further include a suspension system 20 for dynamically suspending the laundry holding system within the structural support system.

The clothes washer 10 may further include a liquid supply system 22 for supplying water to the clothes washer 10 for use in treating laundry during a cycle of operation. The liquid supply system 22 may be coupled with a source of water, such as a household water supply 24, selectively controlled to fill at least one of the tub 14 and the drum 16 with a predetermined amount of wash liquid to wet the fabric load according to a cycle of operation, which may include partially or completely submerging the fabric load.

The clothes washer 10 may also be provided with other conventional systems, such as a dispensing system for dispensing treating chemistry to the treating chamber 18 for use in treating the laundry according to a cycle of operation, a recirculation and drain system for recirculating liquid within the laundry holding system and draining liquid from the clothes washer 10, and a heating system which may include one or more devices for heating laundry and/or liquid supplied to the tub 14.

A clothes mover 26 may be mounted within the drum 16 and may rotate relative to the drum 16 and the tub 14. Rotation of the drum 16 and the clothes mover 26 imparts mechanical energy to the wash liquid and to the fabric load to move the fabric items within the treating chamber 18. The clothes mover 26 is illustrated as a low profile vertical axis impeller. A variety of other designs for the clothes mover 26 may also be used, including, but not limited to an agitator, with or without an auger, and peripheral vanes on the drum 16, or the clothes mover 26 may be omitted altogether without affecting the scope of the invention.

A drive mechanism 28, such as a reversible drive mechanism, may be used to rotate the drum 16 relative to the tub 14. Similarly, the clothes mover 26 may be coupled to the drive mechanism such that the clothes mover 26 can rotate relative to the drum 16 and the tub 14. The drive mechanism 28 can include a drive motor 30 which is operably connected to the clothes mover 26 through an optional transmission 32 and drive belt 34.

The cabinet 12 further has a backsplash forming a control panel 36 that houses a controller 38. The controller 38 may be provided with a central processing unit (CPU) and a memory that may be used for storing the control software that may be executed by the CPU in completing a cycle of operation using the clothes washer 10, and any additional software. Examples, without limitation, of cycles of operation include: wash, heavy duty wash, delicate wash, quick wash, pre-wash, refresh, rinse only, and timed wash. The controller 38 may be operably coupled with one or more components of the clothes washer 10 for communicating with and controlling the operation of the component to complete a cycle of operation.

The laundry holding system may further include a cover 40, illustrated herein as a lid, which may be movably mounted to the cabinet 12 to selectively close both the tub 14 and the drum 16. As illustrated herein, the cover 40 is pivotally mounted to the cabinet 12 by a hinge 42 and can be opened by pivoting the cover 40 upwardly from the closed position shown in FIG. 1 about a generally horizontal axis defined by the hinge 42. The cover 40 can be a door or lid that covers the access opening to the treating chamber 18, which may be defined by align openings of tub 14, drum 16, and/or cabinet 12.

A lock mechanism 44 is provided between the cover 40 and cabinet 12 for selectively locking the cover 40 in the closed position shown in FIG. 1. The lock mechanism 44 can be operable coupled with the controller 38 to automatically engage and lock the cover 40 to the cabinet 12 during a cycle of operation, and to automatically disengage and unlock the door 40 from the cabinet 12 when the cycle of operation is completed. More specifically, the controller 38 can automatically engage the lock mechanism 44 to lock the cover 40 during a spin phase of the cycle of operation, during which wash liquid is removed from the laundry load by spinning the drum 16 at a high speed. The controller can automatically disengage the lock mechanism 44 to unlock the cover 40 from the cabinet 12 when the spin phase is completed; a delay can be incorporated between the end of the spin phase and the unlocking to ensure that the drum 16 has come to a complete stop before the cover 40 can be opened.

Figure 2:
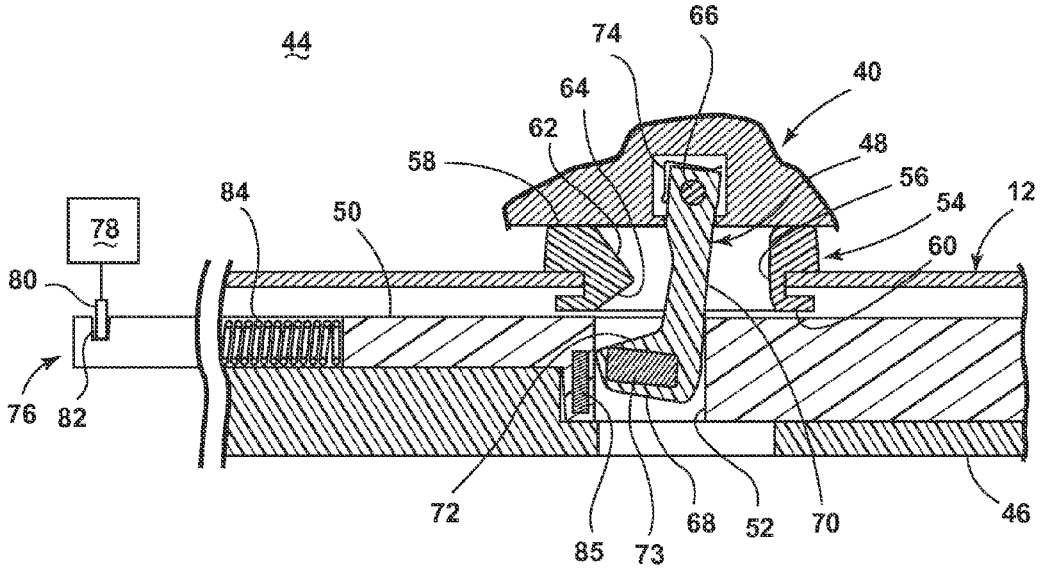
FIG. 2 is a schematic sectional view of a lock mechanism for the clothes washer of FIG. 1 according to a first embodiment of the invention, taken through a first plane of the lock mechanism.

FIG. 2 is a close-up sectional view of a lock mechanism 44 according to a first embodiment of the invention, taken through a first plane of the lock mechanism 44. The lock mechanism 44 can be used with the clothes washer 10 of FIG. 1. The lock mechanism 44 includes a lock body 46 provided on the cabinet 12, a strike 48 provided on the cover 40, a strike trap provided on the housing to selectively retain the strike within the lock body 46. The strike trap is illustrated as a locking slider 50 which slides relative to the cabinet 12 to selectively retain the strike 48 within the lock body 46. When the cover 40 is closed, the strike 48 extends at least partially into an opening 52 in the locking slider 50, but the lock mechanism 44 may not be engaged. The lock mechanism 44 is engaged when movement of the slider 50 against the strike 48 prevents the strike 48 from being retracted from the opening 52. However, the lock mechanism 44 can be configured such that the strike 48 can be released from the lock body, upon application of predetermined force or a "giveaway" force on the cover 40, when the lock mechanism 44 is engaged without damage to the lock mechanism 44. The predetermined force can correspond to a forcible opening of the cover 40, such that a user must apply a larger force to open the cover 40 when the lock mechanism 44 is engaged versus when the lock mechanism 44 is disenaged. In one example, the lock mechanism 44 can be configured to forcibly open upon application of approximately 30 lb of force.

The lock body 46 can be fixedly mounted to or formed with the cabinet 12, such that the lock body 46 does not move relative to the cabinet 12. A bezel 54 is provided on the exterior of the cabinet 12 and surrounds the opening 52. The bezel 54 can include a bezel opening 56 which is at least partially aligned with the opening 52, an upper surface 58, and a lower surface 60 against which the strike 48 is trapped when the lock mechanism 44 is engaged. The upper surface 58 includes an upper angled face 62 oriented to slope toward the bezel opening 56 and the lower surface 60 includes a lower angled face 64 oriented to slope away from the bezel opening 56.

The strike 48 is pivotally mounted to the cover 40 about an axis X by a pivot shaft 66, and includes a catch 68 that is spaced from the pivot shaft 66 and an arm 70 that joins the pivot shaft 66 to the catch 68. The catch 68 can comprise a hooked end 72 that extends outwardly from the arm 70. The hooked end 72 of the catch 68 can contain a magnetic material 73. A spring 74 biases the hooked end 72 of the strike 48 away from the locking slider 50 and can comprise a leaf spring.

The locking slider 50 is provided beneath the bezel 54 and is operably coupled with a slider control mechanism 76 for moving the slider 50 against the strike 48 to prevent the strike 48 from being retracted from the opening 52. The slider control mechanism 76 can comprise any suitable control mechanism 76 that can move the locking slider 50 into proper position against the strike 48 and trap the strike 48 within the opening 52. In one example, the slider control mechanism 76 can include a solenoid 78 and a pin 80 that is selectively received in a pin slot 82 formed in the slider 50. The slider 50 can be configured to be automatically positioned against the strike 48 when the cover 40 is closed, but may not be locked in place until the solenoid 78 moves the pin 80 into the pin slot 82. The solenoid 78 can be electrically coupled with the controller 38 (FIG. 1) for selectively actuating the pin 80 to move into the pin slot 82, thereby trapping the slider 50 in position against the strike 48 within the opening 52. A spring 84 biases the locking slider 50 against from the strike 48, and can comprise a compression spring. The locking slider 50 can include a magnet 85 configured to attract the magnet material 73 in the strike 48.

Figure 3:
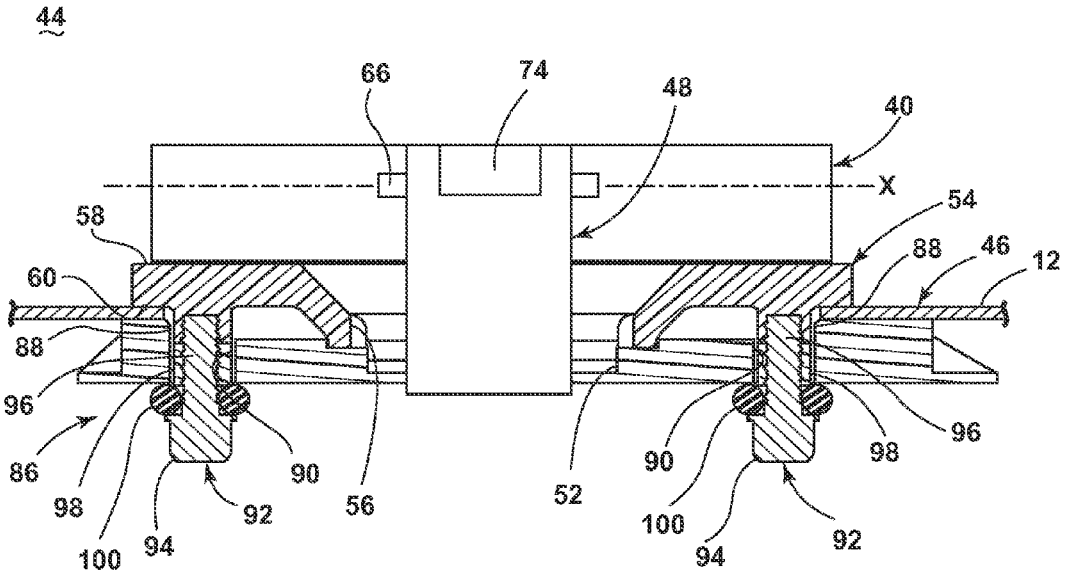
FIG. 3 is a schematic sectional view of the lock mechanism of FIG. 2, taken through a second plane of the lock mechanism that is substantially perpendicular to the first plane.

FIG. 3 is a schematic sectional view of the lock mechanism 44 of FIG. 2, taken through a second plane of the lock mechanism 44 that is substantially perpendicular to the first plane. The bezel 54 is moveably mounted to the cabinet 12, such that the bevel 54 can move relative to the cabinet 12 within a constrained degree. As shown herein, a floating mount 86 is provided between the bezel 54 and the lock body 46, such that the bezel 54 can move vertically up and down relative to the lock body 46, thereby moving vertically up and down relative to the cabinet 12. The floating mount 86 includes a pair of spaced screw bosses 88 on the lower surface 60 of the bezel 54, a pair of corresponding screw holes 90 in the lock body 46, and a pair of screws 92 which extend through the screw holes 90 and into the screw bosses 88 to mount the bezel 54 to the lock body 46. Each screw 92 includes a screw head 94 and a threaded shaft 96 extended from the head 94. A spacer 98 can be provided on the threaded shaft 96, against the head 94, and can be made from or coated with a material having a low coefficient of friction, such as nylon. The spacer 98 can be separate from or formed with the screw 92. A self-retaining O-ring 100 can be provided around the spacer 98, between the heat 94 and the lock body 46, and can be retained on the spacer 98 and against the head 94 using an interference fit. The O-rings 100 prevent the lock mechanism 44 from opening under an application of force that is less than the predetermined force.

Figure 4:
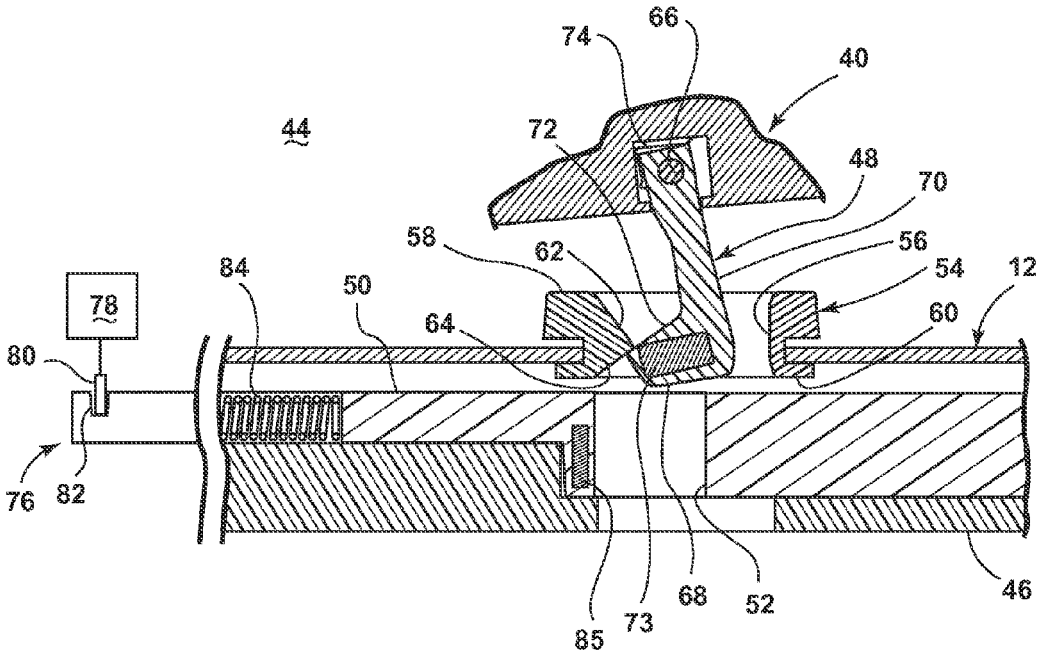
FIG. 4 is a schematic sectional view similar to FIG. 2, illustrating the forcible opening of the cover.
Figure 5:
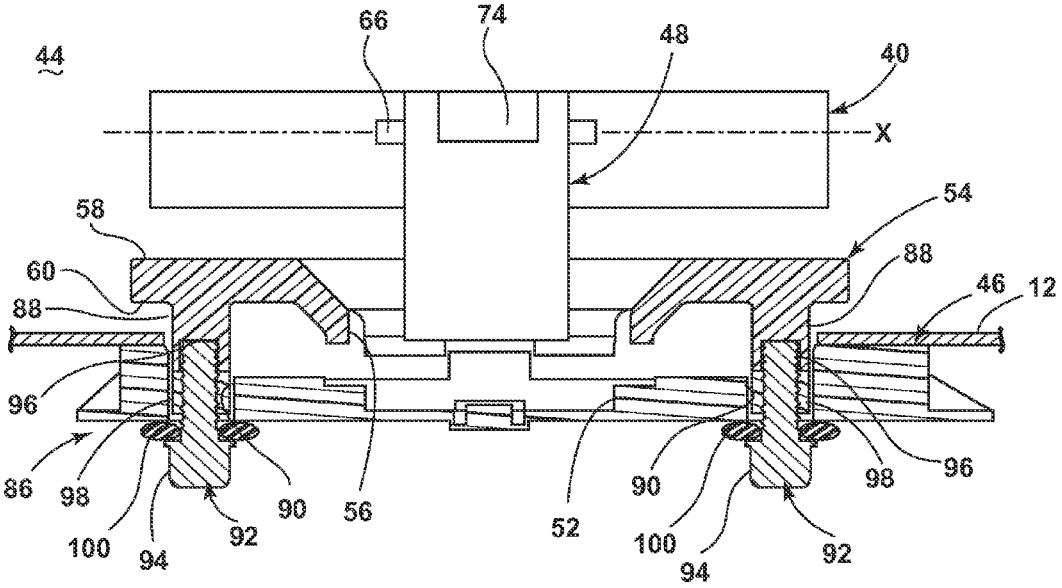
FIG. 5 is a schematic sectional view similar to FIG. 3, illustrating the forcible opening of the cover.

FIGS. 2-3 illustrated the position of the components of the lock mechanism 44 when the lock mechanism 44 is engaged. FIGS. 4-5 illustrating the forcible opening of the cover 40 when the lock mechanism 44 is engaged. Upon the application of a suitable predetermined force by a user, the cover 40 can be opened when the lock mechanism 44 is engaged. Lifting the cover 40 raises the strike 48 within the bezel opening 56 and the hooked end 72 contacts the lower engaged face 64 of the bezel 54. The bezel 54 is raised upwardly by engagement with the strike 48, while the locking slider 50 remains fixed in place. When the bezel 54 moves upwardly, the O-ring is compressed. The bezel 54 may raise a sufficient amount such that the strike 48 clears the locking slider 50 and the cover 40 can be separated from the cabinet 12. When the bezel 54 is released, i.e. separated from the strike 48, the O-ring 100 acts as a return mechanism and decompresses to push the bezel 54 back to the position shown in FIG. 3. The predetermined force required to open the cover 40 can be determined by the compression of the O-rings 100 and/or the screw bosses 88 bearing down inside the screw holes 46 in the lock body 46 when the bezel 54 is pulled up. The screw bosses 88 and the bezel 54 can flex to allow the strike 48 to escape at a certain force. This approach greatly reduces the risk of variation in the screws 92, O-rings 100, and assembly of the lock mechanism 44 to affect the predetermined force. Thus, while the embodiment of the lock mechanism 44 shown herein relies on both the compression of the O-rings and the flexing of the bosses 88 and bezel 54 to set the predetermined force and permit the bezel 54 to move, it is understood that either could be used alone to achieve the same result of the cover 40 being forcibly opened without damage to the lock mechanism.

Figure 6:
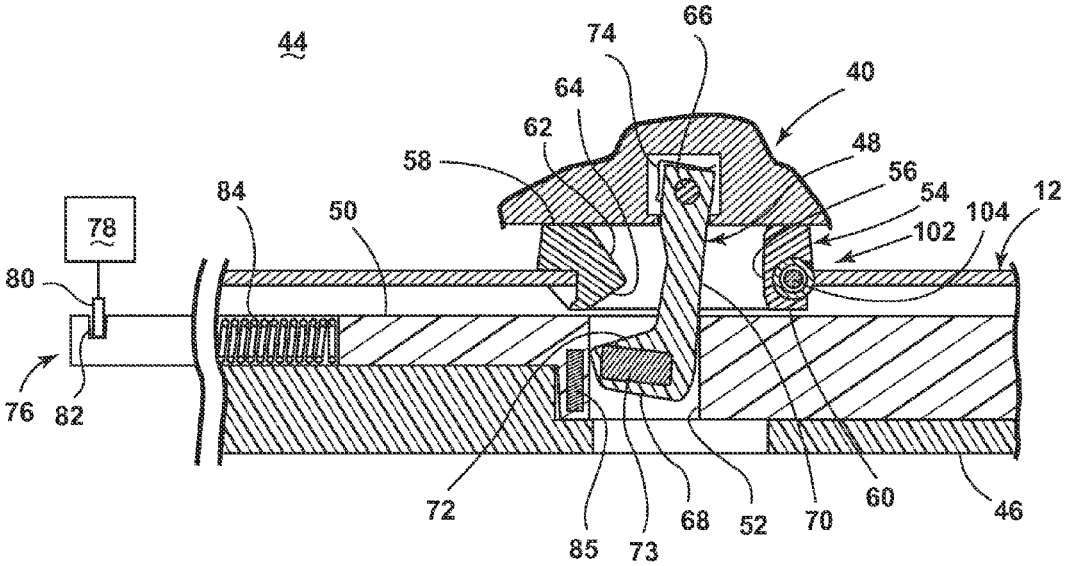
FIG. 6 is a schematic sectional view of a lock mechanism for the clothes washer of FIG. 1 according to a second embodiment of the invention, taken through a first plane of the lock mechanism.

FIG. 6 is a schematic sectional view of a lock mechanism 44 according to a second embodiment of the invention, taken through a first plane of the lock mechanism 44. The lock mechanism 44 can be used with the clothes washer 10 of FIG. 1. The lock mechanism 44 can be similar to the first embodiment, with the exception that the bezel 54 can be provided with a pivoting mount 102 between the bezel 54 and the cabinet 12, instead of the floating mount 86 used in the first embodiment. The pivoting mount 102 includes a pivot shaft 104 provided on the bezel 54 which pivotally mounts the bezel 54 to the cabinet 12. The pivot shaft 104 can be provided on the side of the bezel opening 56 opposite the angled faces 62, 64 in order to permit the angled faces 62, 64 to be pivoted relative to an axis of rotation defined by the pivot shaft 104.

Figure 7:
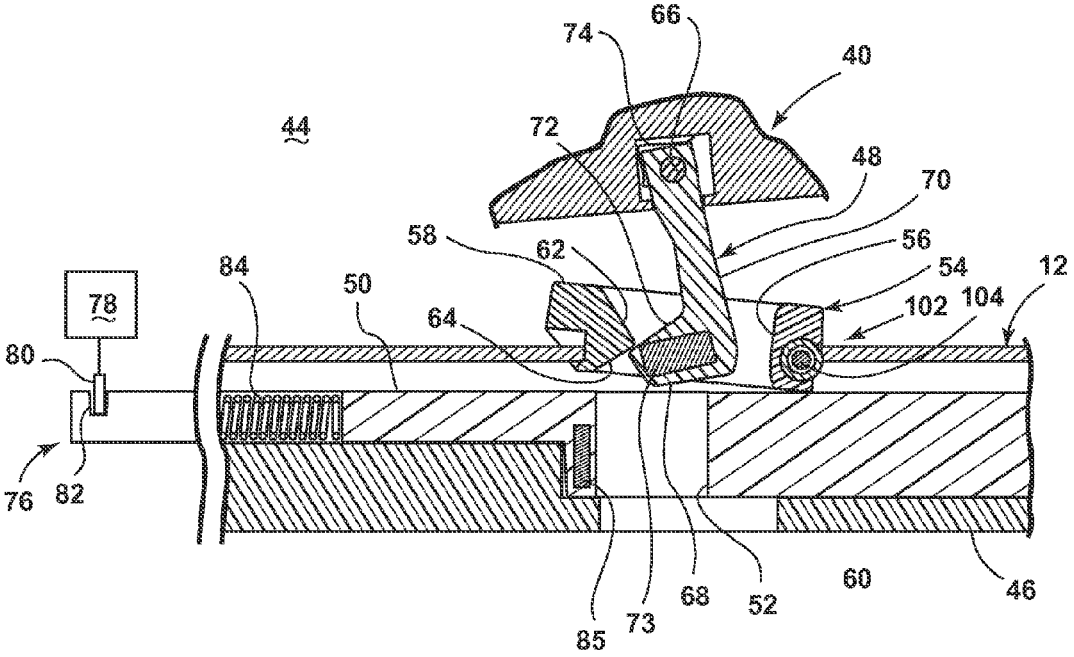
FIG. 7 is a schematic sectional view similar to FIG. 6, illustrating the forcible opening of the cover.

FIG. 7 illustrates the forcible opening of the cover 40. Upon the application of a suitable predetermined force by a user, the cover 40 can be opened when the lock mechanism 44 is engaged. Lifting the cover 40 raises the strike 48 within the bezel opening 56 and the hooked end 72 contacts the lower engaged face 64 of the bezel 54. The bezel 54 is pivoted upwardly about the axis of rotation defined by the pivot shaft 104 by engagement with the strike 48, while the locking slider 50 remains fixed in place. The bezel 54 may pivot a sufficient amount such that the strike 48 clears the locking slider 50 and the cover 40 can be separated from the cabinet 12. When the bezel 54 is released, i.e. separated from the strike 48, the bezel 54 falls back under the force of gravity to the position shown in FIG. 6.

Figure 8:
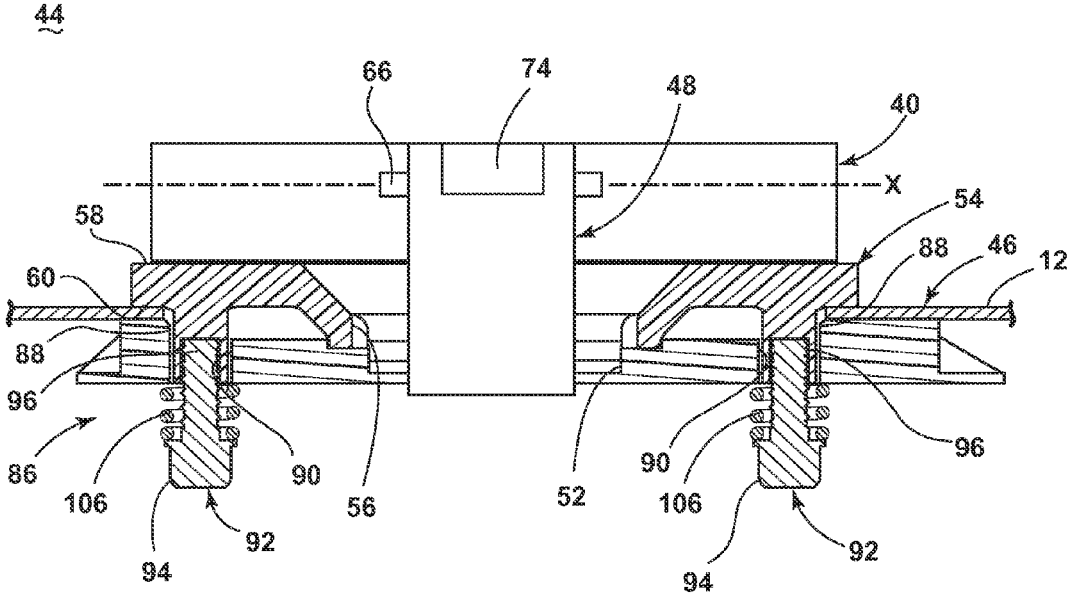
FIG. 8 is a schematic sectional view of a lock mechanism for the clothes washer of FIG. 1 according to a third embodiment of the invention, taken through a first plane of the lock mechanism.

FIG. 8 is a schematic sectional view of a lock mechanism 44 according to a third embodiment of the invention, taken through a first plane of the lock mechanism 44. The lock mechanism 44 can be used with the clothes washer 10 of FIG. 1. The lock mechanism 44 can be similar to the first embodiment, with the exception that, as an alternative to the spacer 98 and O-ring 100, a compression spring 106 can be provided around the shaft 96, between the head 94 and lock body 46, to bias the bezel 54 toward the lock body 46. When the bezel 54 is separated from the strike 48, the spring 106 acts as a return mechanism and decompresses to push the bezel 54 back to the position shown in FIG. 8. The predetermined force required to open the cover 40 can be determined by the spring 106 and the integrity of the screws 90.

It is noted that while the lock mechanisms 44 are illustrated as having a strike trap provided by the locking slider 50 and the slider control mechanism 76, it is within the scope of the invention for the moveable bezel 54 according to any of the above embodiments to be used with other types of strike traps for the strike 48.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance for treating a laundry load according to at least one cycle of operation, the laundry treating appliance comprising:
- a housing having an access opening;
- a treating chamber provided in the housing for receiving the laundry load via the access opening for treatment according to the at least one cycle of operation;
- a cover moveably mounted to the housing to selectively close the access opening; and
- a lock mechanism to secure the cover closed over the access opening, the lock mechanism comprising:
  - a bezel provided on the housing and defining a bezel opening;
  - a strike provided on the cover and selectively received by the bezel opening; and
  - a strike trap provided on the housing to fixedly retain the strike within the bezel opening;
  - wherein the bezel is upwardly movable relative to the housing in a manner to enable the strike to clear the strike trap against a predetermined upward force acting on the cover.

2. The laundry treating appliance from claim 1, wherein the lock mechanism comprises a floating mount between the bezel and the housing, wherein the bezel is vertically movable relative to the housing to enable the strike to be freed from the strike trap against a predetermined force acting on the cover.

3. The laundry treating appliance from claim 2, wherein the floating mount comprises at least one screw mounting the bezel to the housing.

4. The laundry treating appliance from claim 3, wherein the at least one screw comprises a head and a threaded shaft, and the floating mount comprises a spacer provided on the threaded shaft.

5. The laundry treating appliance from claim 4, wherein the floating mount comprises an O-ring provided on the spacer.

6. The laundry treating appliance from claim 5, wherein the floating mount comprises a spring provided around the threaded shaft.

7. The laundry treating appliance from claim 1, wherein the lock mechanism comprises a pivoting mount between the bezel and the housing, wherein the bezel is pivotally movable relative to the housing to enable the strike to be freed from the strike trap against a predetermined force acting on the cover.

8. The laundry treating appliance from claim 7, wherein the pivoting mount comprises a pivot shaft provided on the bezel and defining an axis of rotation for the bezel.

9. The laundry treating appliance from claim 1, wherein the bezel comprises an upper angled face oriented to slope toward the bezel opening and a lower angled face joined with the upper angled face and oriented to slope away from the bezel opening.

10. The laundry treating appliance from claim 1, wherein the strike trap comprises a locking slider provided on the housing and slidable relative to the housing to selectively retain the strike within the bezel opening.

* * * * *